US005329985A

United States Patent [19]

Weimann

[11] Patent Number: 5,329,985

[45] Date of Patent: Jul. 19, 1994

[54] METHOD AND APPARATUS FOR THE INDIVIDUAL MARKING OF GREEN SAND MOLDS

[75] Inventor: Wendelin Weimann, Klettgau, Fed. Rep. of Germany

[73] Assignee: Georg Fischer AG, Schaffhausen, Switzerland

[21] Appl. No.: 40,865

[22] Filed: Mar. 31, 1993

[30] Foreign Application Priority Data

Apr. 10, 1992 [CH] Switzerland ..... 01180/92

[51] Int. Cl.[5] ..... B22C 23/00

[52] U.S. Cl. ..... 164/229; 164/4.1

[58] Field of Search ..... 164/4.1, 456, 17, 6, 164/15, 229, 150, 154, 40, 412

[56] References Cited

U.S. PATENT DOCUMENTS

| | | | |
|---|---|---|---|
| 918,342 | 4/1909 | Lose | 164/150 |
| 4,137,962 | 2/1979 | Pol | 164/412 |
| 4,708,314 | 11/1987 | Kühling | 164/229 |

FOREIGN PATENT DOCUMENTS

| | | | |
|---|---|---|---|
| 2620370 | 3/1989 | France | 164/229 |
| 6018212 | 6/1976 | Japan | 164/15 |
| 0019151 | 2/1982 | Japan | 164/15 |

*Primary Examiner*—Paula A. Bradley
*Assistant Examiner*—Erik R. Puknys
*Attorney, Agent, or Firm*—Bachman & LaPointe

[57] ABSTRACT

A method and an apparatus for marking green sand molds are proposed, in which the surface of the sand is individually marked by means of an identification once compacting of the molds in the mold cavity has taken place, in such a way that the marking is transferred from the surface of the sand to the casting by the casting operation.

10 Claims, No Drawings

METHOD AND APPARATUS FOR THE INDIVIDUAL MARKING OF GREEN SAND MOLDS

BACKGROUND OF THE INVENTION

The present invention relates to a method and an apparatus for the individual marking of green sand molds.

To reduce the number of reject parts during casting due to pattern plate wear, defective shims or cores and incorrect inoculation, it is known to apply identification marks or tags to the pattern plates. The core marks or tags contain the following information: production year, production month, production day, hour and quarter of an hour. Until now, these identification marks/tags have been altered manually at approximately quarter-hourly intervals.

A disadvantage of the known methods is the loss in cycle time which occurs four times every hour when altering the marks. In addition, the additional set-up times necessary when changing a pattern for applying or removing the marks/tags, which involves relatively high costs in pattern making, must be taken into consideration.

In addition, the vertical integration of production in most product sectors is nowadays considerably less than in past years and in the automobile industry is currently about 35%. This means that about 65% of automotive parts are produced by outside companies or subcontractors. The products from the subcontractors therefore have to be unequivocally marked, in order that 1. the supplier can be established as the producer of the product,
2. the product can be identified and
3. the product marking can be verified.

The markings must be applied in a way appropriate for the material, that is they must not impair the function of the parts and should be indelible so that they do not become illegible by the normal use or operation of the castings.

A marking appropriate for a purpose or material initially only has the effect of causing costs, both on the design side and on the production side, so that the use of a cost-effective method is of major importance.

It is the principle object of the present invention to provide a method for marking sand molds which can be used cost-effectively for high-speed molding plants. The method of the present invention saves cycle time losses and pattern making costs. In addition, it is possible to integrate the method into existing molding plants without any great expenditure of time and money.

SUMMARY OF THE INVENTION

The foregoing object is achieved by way of the present invention by individually marking the surface of the sand with an identification once compacting of the molds in the mold cavity has taken place, such that the marking identification is transferred from the surface of the sand to the casting during the metal casting operation.

DETAILED DESCRIPTION

The method of the present invention comprises a method for applying indicia to a cast metal product. The method comprises the steps of providing a compacted green sand mold to be used in metal casting. The compacted sand mold may be produced by a number of methods known in the art.

In accordance with the present invention an indicia in the form of an identifying mark is applied to the surface of the compacted green sand mold which will be contacted by the molten metal during metal casting. The indicia may be applied to the surface of the sand mold by any of the preferred methods described hereinbelow. Once the indicia is applied molten metal is cast into the sand mold in known manner and contacts the surface of the sand mold bearing the indicia. Upon solidification, the indicia is transferred from the sand mold to the cast product.

Preferred embodiments of the method according to the invention are explained in more detail with reference to the following examples.

The marking can take place by numbering with a fixed die through contact. This means that all data (figures) necessary for the marking have to be pressed into the surface of the mold simultaneously with one another. Altering of the numbers can in this case be performed either inside the die or by automatic exchanging of individual figures within the die set, which is picked up by a gripper and pressed onto the surface of the mold.

The particular advantage is that the numbering operation as such is very quick and the control necessary for it can be kept simple. In this case, the die must be monitored by means of a load cell in order to limit the maximum effective compressive force.

The marking of the molds may also be performed with a movable die through contact. This can take place in the following way: An embossing head comprising a guided hard-metal needle with an acute angle of 60° which, oscillating at an adjustable frequency, is pressed into the surface of the mold by a single-acting small pneumatic cylinder. Each figure is in this case built up from many individual dots, which form a line. The displacement of the embossing head is controlled by a computer.

The particular advantage of this type of marking is that unevennesses and a certain roughness of the mold surface are tolerated. In addition, it is a cheap tool which can be exchanged within an extremely short time. The forces acting on the mold are very small.

In a further embodiment the marking may be made by ultrasound. The sound wave is made to resonate inside a tube open to the mold contour, in order to intensify the sound pressure. It is intended here to use the fact that ultrasound can be concentrated well and emitted in a targeted manner. The inscribing of the mold is performed by post-compacting of the sand.

The inscribing of the sand molds may also be performed by means of a laser beam. In the case of this method, the following advantages are obtained:

inscription on rough and uneven surfaces possible
clear script and high contour sharpness
no exact positioning necessary
no direct die wear
no forces on the workpiece
no conversation time when changing symbols
markings can be changed at the speed of a computer.

Various laser systems may be used, for example semiconductor lasers, liquid lasers, solid-state lasers, glass lasers.

Tests have shown that laser inscription does not have any adverse effects on the casting result. What was surprising was that even extremely fine contours produced with the laser are produced so outstandingly with viscous nodular cast iron.

It is to be understood that the invention is not limited to the embodiments described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method of marking green sand casting molds comprising marking a surface of the sand mold after compacting of the sand mold in a mold cavity and removing the sand mold from the mold cavity with an identification mark which is transferred from the surface of the sand mold to the casting during a casting operation.

2. A method according to claim 1 including applying the identification by contacting the surface of the sand mold under pressure with a die bearing the identification.

3. A method according to claim 2 including controlling the pressure at which the die is applied to the surface of the sand mold.

4. A method according to claim 1 including applying the identification by means of a laser beam.

5. A method according to claim 1 including applying the identification by means of ultrasound.

6. A method of applying indicia to a cast product comprises:

(a) compacting a sand mold in a mold cavity;

(b) removing the compacted sand mold from the mold cavity;

(c) applying indicia to a surface of the compacted sand mold to be contacted by molten metal;

(d) casting molten metal into said compacted sand mold such that molten metal contacts said surface of the compacted sand mold; and (e) soldifying said cast metal in said compacted sand mold whereby said indicia is transferred to the cast product.

7. A method according to claim 6 including applying the indicia by contacting the surface of the compacted sand mold with a die bearing the indicia.

8. A method according to claim 7 including controlling the pressure at which the die is applied to the surface of the compacted sand mold.

9. A method according to claim 6 including applying the indicia by means of a laser beam.

10. A method according to claim 6 including applying the indicia by means of ultrasound.

* * * * *